United States Patent [19]

Freudenberg

[11] Patent Number: 4,610,633

[45] Date of Patent: Sep. 9, 1986

[54] KAYAK PADDLE

[76] Inventor: Kenton L. Freudenberg, 1619 Forest Ave., Durango, Colo. 81301

[21] Appl. No.: 723,002

[22] Filed: Apr. 15, 1985

Related U.S. Application Data

[63] Continuation of Ser. No. 388,182, Jun. 18, 1982, abandoned.

[51] Int. Cl.[4] ..... B63H 16/04

[52] U.S. Cl. ..... 440/101; 416/74; D12/215

[58] Field of Search ..... 440/101-105, 440/110; D12/215; 416/69, 70 A, 70 R, 74; 273/82; 144/329, 344, 345, 350

[56] References Cited

U.S. PATENT DOCUMENTS

| | | | |
|---|---|---|---|
| 936,165 | 10/1909 | Richardson | 416/70 |
| 1,736,425 | 2/1925 | Bluhm | 273/82 R |
| 2,246,411 | 6/1941 | Kraft | 273/82 R |
| 2,471,316 | 5/1949 | Diehl | 273/82 R |
| 2,654,606 | 10/1953 | Stearns et al. | 273/82 R |
| 2,763,015 | 9/1956 | Weigand | 416/70 |
| 3,025,538 | 3/1962 | Noland | 440/101 |
| 3,258,795 | 7/1966 | Mailhot | 441/68 |
| 4,265,450 | 5/1981 | Drake et al. | 273/73 R |

FOREIGN PATENT DOCUMENTS

| | | | |
|---|---|---|---|
| 2604597 | 8/1977 | Fed. Rep. of Germany | 440/101 |
| 2501619 | 9/1982 | France | 440/101 |
| 1339719 | 12/1973 | United Kingdom | 440/101 |

OTHER PUBLICATIONS

Canoe Magazine, Mar.-Apr. 1977, p. 59, FIGS. B and D.

Camping Magazine, 1960, p. 34.

*Primary Examiner*—Trygve M. Blix
*Assistant Examiner*—Stephen P. Avila
*Attorney, Agent, or Firm*—Low and Low

[57] ABSTRACT

A wood kayak or canoe paddle having a rubber-like shock-absorbing abrasion-resistant flexible strong strip of urethane rubber adhered to the tip of each blade, and preferably extending also along the opposite edges of the blade, to strengthen the blade and reduce the likelihood of damage to the blade by rocks sand or other solid abrasive material during paddle use. Each paddle face is reinforced adjacent the rubber-like strip by a thin layer of carbon fibers lying parallel to the strip and each entire paddle face is covered with a thin layer of glass fabric embedded in a water resistant flexible coating. The paddle shaft is laminated of ash and sitka spruce with reinforcement by high tensile strength fibers at the lamination interfaces and added ash laminations adjacent the shaft extension in the paddle blade.

31 Claims, 18 Drawing Figures

Figure 1:
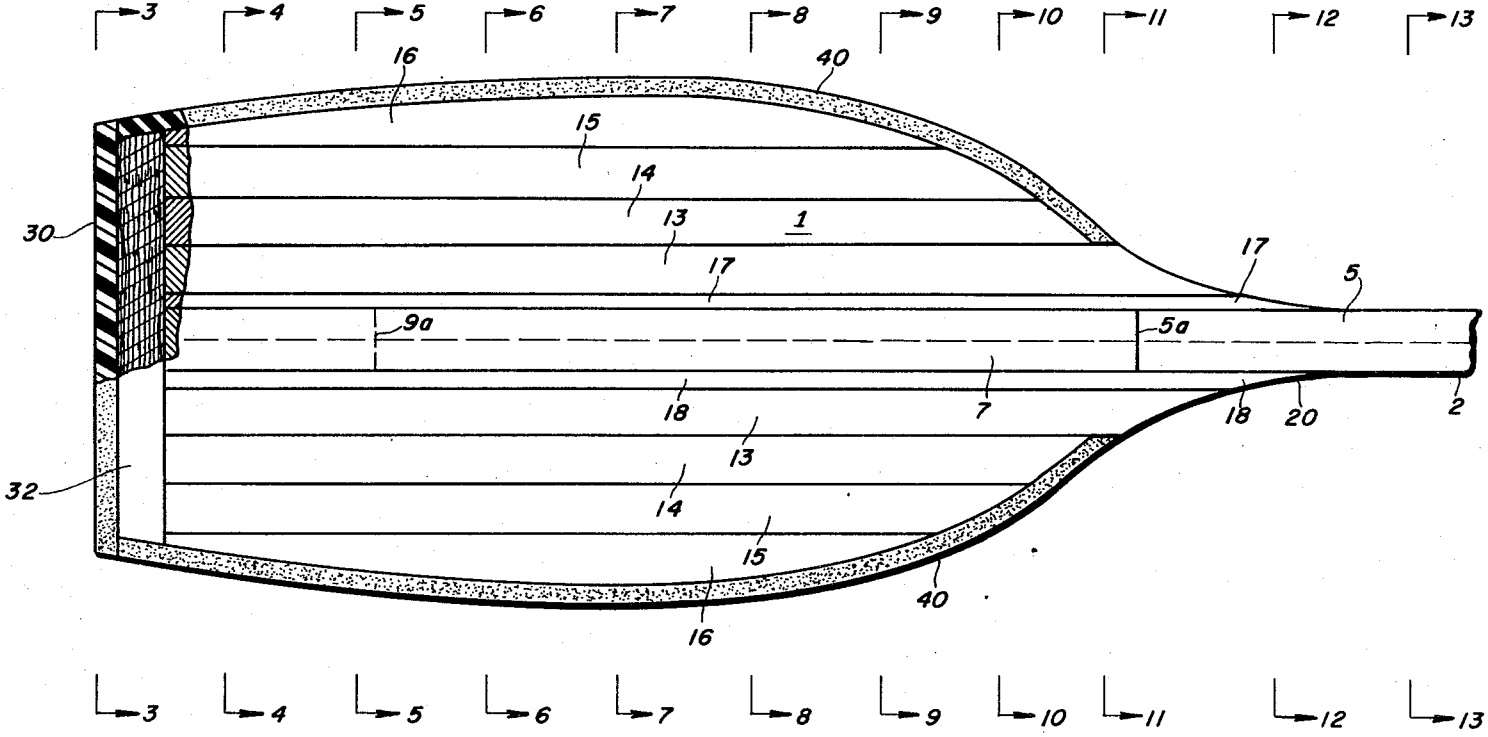

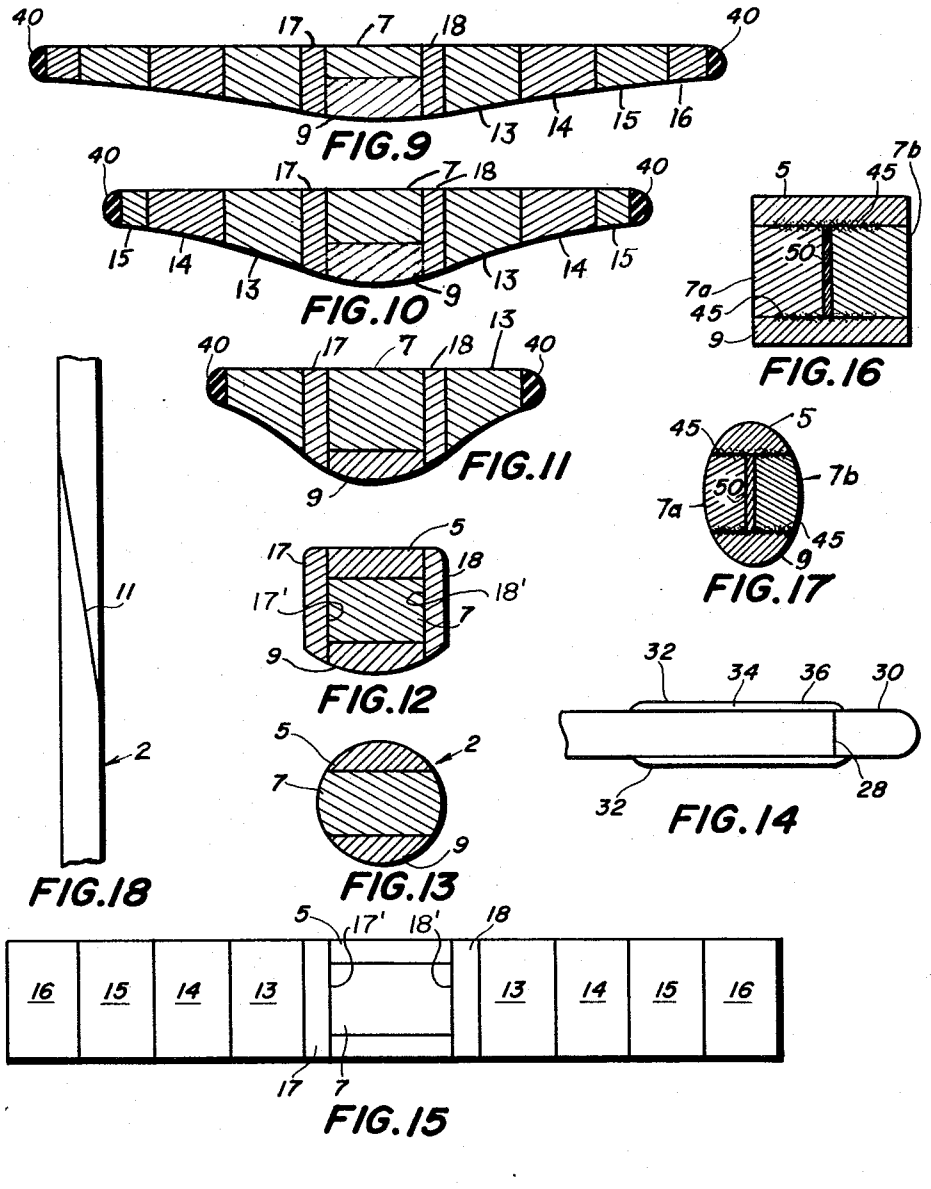
FIG.9
FIG.10
FIG.11
FIG.12
FIG.13
FIG.14
FIG.15
FIG.16
FIG.17
FIG.18
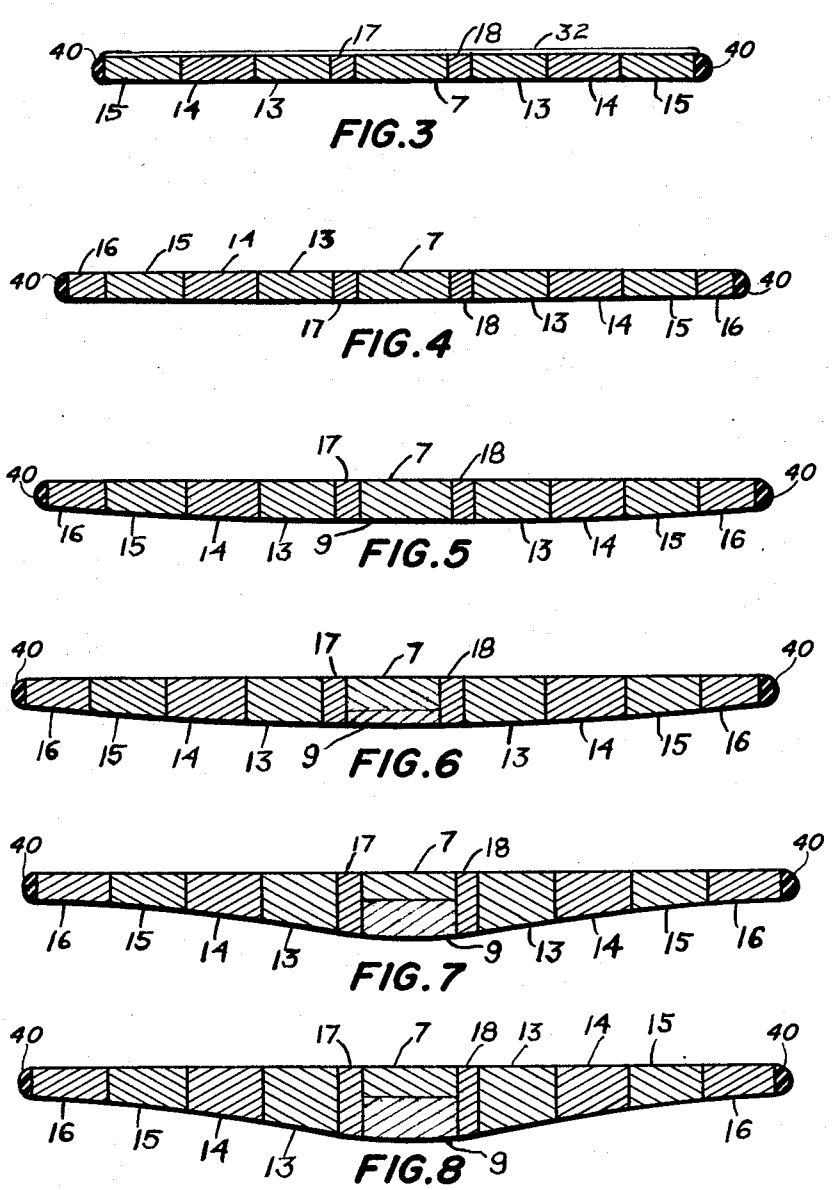
FIG.3
FIG.4
FIG.5
FIG.6
FIG.7
FIG.8

KAYAK PADDLE

This is a Continuation/Division of application Ser. No. 388,182, filed June 18, 1982 now abandoned.

This invention relates to improvements in kayak paddles or any other paddles where the paddle blade is subjected to abuse by shock and abrasion either during use or when merely being handled, transported or stored.

Kayak paddles are preferably made of wood to keep them light in weight, keep them buoyant in case they are lost during use, to give them a better 'feel' to the user and to make them more attractive. The edges of the blade are often of the order of 3/16-inch to ¼-inch or even less in thickness and have no significant protection against wear and breakage when they are poked or rubbed against hard abrasive bodies in streams or the stream bottom or on shore. One common solution to strengthen and protect the tip of wood blades has been to wrap a sheet of metal around the blade tip and secure it to the blade by rivets. With such an arrangement the stresses between the blade and the metal protector are concentrated at the rivets and are conducive to splitting of the blade, particularly where the grain of the wood in the blade is parallel to the length of the paddle. Another drawback to a typical prior-art metal protector is that the edge of the metal, even when extending only slightly above the surface of the blade can get caught momentarily on a jagged surface of a rock and not only create stresses in the blade as mentioned, but also disturb the balance or stroking of the paddler, which can be disastrous, particularly in competition. Another common method of trying to protect the blade edges is to build up a surface of epoxy, usually with other thin layers of material such as wood or glass cloth. However, such structures have not combined the features of resiliency and abrasion resistance as has been achieved with the present invention. Another method of attempting to protect the blade has been to laminate a piece of hardwood along the edge. However, such a wood strip, even if covered with a fabric and epoxy, is still more subject to shocks and abrasion than a blade made in accordance with the present invention.

It is an object of this invention to improve the construction of the shaft and blade portions of a wood kayak paddle to strengthen them and reduce damage thereto from contact with solid objects during use.

Another object of this invention is to enable a paddle to withstand much greater shock without damage when the blade of the paddle strikes a rock or other relatively immovable object.

Still another object of the invention is to facilitate storage and transportation of paddles without having to wrap or otherwise protect the easily damaged edges of a wood paddle blade.

In accordance with one of the features of this invention, shock absorption is achieved by means of a flexible strip of resilient urethane plastic material adhered to the tip of a paddle blade by a water-resistant flexible bonding material, such as an epoxy resin. The urethane strip is preferably molded to its desired shape before being adhered to the blade tip. This enables the surfaces of the strip and the paddle tip to be better prepared for optimum adherance thereto of the adhesive bonding material. The thickness of the strip should be the same as the thickness of the paddle at its tip so that the strip is in effect merely an extension of the paddle face. The shock-absorbing strip may extend along the opposite edges of the blade. Reinforcement of the strength of the handle shaft and portions of the blade by specialized use of carbon, glass or other high tensile strength fibers assists the shock-absorbing strips in maintaining the integrity of the paddle during rough use which is quite common in running white-water in a kayak.

Figure 2:
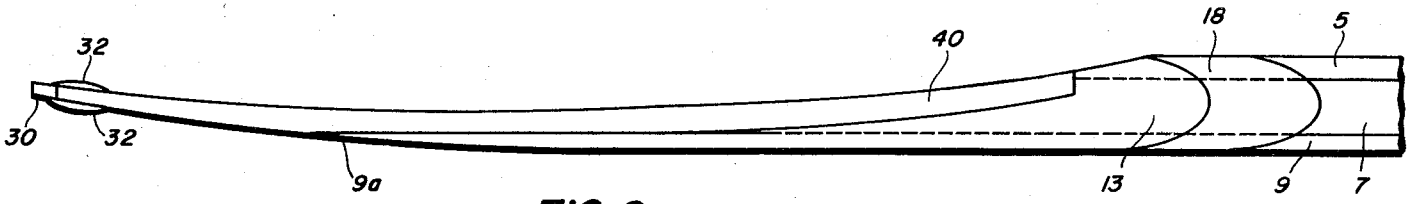

Referring to the drawings, FIG. 1 is a view of the convex face of a paddle blade representing one end of a paddle with most of the handle shaft and the other paddle blade cut away. FIG. 2 is a side view of the blade of FIG. 1. Regularly spaced section lines on FIG. 1 correspond to cross-section outlines of the blade shown in FIGS. 3 through 13. FIG. 14 is an enlarged transverse view of the tip of the paddle to better illustrate features thereat. FIG. 15 is an end view of a laminated block of wood from which the paddle blade and one half of the paddle handle shaft is sculptured. FIG. 16 is an end view of a modification of the invention for reinforcing the paddle shaft. FIG. 17 is a cross section of the gripping portion of a shaft embodying a modification of the invention. FIG. 18 shows a scarf joint for connecting two bladed portions of a paddle at a central portion of the handle shaft.

A kayak paddle is typically about 200 to 212 centimeters from tip to tip and the width of the blade at its maximum is slightly over 20 centimeters or about 8 inches. Half of a paddle, i.e., one blade and half of the shaft, may be carved from a laminated block shown in FIG. 15. The shaft is made from extensions of the two outer laminations 5 and 9 and an intermediate lamination 7. These three central laminations of the block in FIG. 15 extend sufficiently beyond one end of the block to permit one half of the handle shaft to be carved therefrom. Since the kayak paddle blades lie in planes essentially at right angles to each other at opposite ends of the paddle, the two essentially identical halves of the paddle, each comprising a blade 1 and a handle shaft portion 2, are manufactured and then adhered to each other at a scarf joint 11 as in FIG. 18. A right handed paddler generally cocks his right wrist when alternating strokes and this requires that a paddle have the blades so arranged with respect to each other that when you stand the paddle vertically in front of you with the concave face of the blade at your feet toward you, the concave face of the blade at the upper other end of the paddle will face to your right.

The block in FIG. 15 is laminated with four outer lamination strips 13, 14, 15 and 16 at each side of a central portion consisting of four wood strips 5, 9, 17 and 18 surrounding the intermediate filler wood strip 7. Each of the four strips 5, 9, 17 and 18 is ¼ by 1¼ inches in cross section and the filler strip is ¾ by 1¼ inches. The laminations need be only long enough, i. e. not more than 20 inches, to form the corresponding portions of the paddle blade, but the three laminations 5, 7 and 9 must extend beyond the blade portions to form the handle shaft 2. Together the outer dimensions of these latter three strips 5, 7 and 9 define the maximum size of the shaft as one and one quarter inches. When each paddle half is carved, the portion of shaft 2 beyond the blade is initially circular in cross section over its length from the neck 20 adjacent the blade to the end away from the blade. After the half is carved, a portion of the shaft is formed to an oval cross section, like that of FIG. 17, over a length of about 12 inches extending from about 20 to 32 inches from the blade tip. The major dimension of the oval, which remains at 1¼ inches, is generally perpendicular to the plane of the blade. This oval configuration allows the paddler to sense the orientation of the paddle in his hands.

As seen in the enlarged section of FIG. 14, the squared tip 28 of the blade has adhered thereto a elastomeric or rubber-like shock-absorbing means consisting of a pre-moulded urethane rubber strip 30. This strip 30 has a rounded outer edge and a maximum thickness essentially no greater than the thickness of the blade at its tip. Typically this thickness is ¼ inch or less. The width of this strip may vary from a minimum where the strip has a semi-circular cross-section with a width then equal to half the blade thickness, to a maximun width of approximately twice the blade thickness. It may be desirable to keep this width to approximately equal the blade thickness to reduce the stress on the bond between the strip and the blade tip when the strip is subject to transverse shocks tending to break the strip away from the blade tip, but this is at some sacrifice due to the reduced shock-absorbing capability of the narrower strip.

Extending transversely of the blade 1 at the tip end thereof on each of its faces is a thin layer 32 of material comprising high tensile strength fibers 34 embedded in an epoxy adhesive 36. These fibers extend parallel to the rubber strip 30 immediately adjacent thereto. The length of the fiber material 32 and the direction of its high tensile strength extends along the tip edge of the blade generally transversely of or perpendicular to the grain of the laminated wood portions of the blade, the grain being generally parallel to the length of the paddle. The fiber layer 32 strengthens the tip of the blade just inside the rubber strip 30 to help keep the wood laminations from splitting, inasmuch as the rubber strip 30 could otherwise elongate when the blade is subject to unusual stress. In other words, the rubber strip 30 is permitted to compress transversely when absorbing shocks, but its lengthwise elongation is limited, in the event of a crack in one of the blade laminations, by the fiber layers 32. The fibers are preferably carbon fibers with the individual fibers extending parallel to the rubber strip. A satisfactory strip of fibers is one inch in width with a thickness before bonding to the blade of 0.0093 inches. Such a strip has approximately 40,000 individual continuous carbon fibers therein. The epoxy bonding adhesive 36 should thoroughly penetrate the body of fibers 34 for optimum adherence to the blade. The protective edge means comprising the strip 30, the fiber layers 32 and the epoxy bonding adhesive 36 effectively forms a grooved or recessed structure of generally U-shaped cross section which receives, or wraps around, the end edge of the paddle as best seen in FIGS. 2 and 14. This contributes to the strength of the protective edge and facilitates bonding it to the blade tip to be protected.

The rubber strip 30 is preferably urethane rubber having physical properties of high tensile strength, high tear resistance, high elongation, elasticity, high resistance to abrasion, moldable at room temperature and very good resistance to fresh and salt water. The rubber strip preferably has a hardness in the range of 60 to 94 Shore A durometer. A suitable urethane rubber compound is available from Devcon Corp. of Danvers, Mass., under the product name Flexane with Shore A hardness and other properties as indicated in the following table.

| | | | |
|---|---|---|---|
| Hardness (Shore A ASTM D2240) | 60 | 80 | 94 |
| Tensile strength (kgf/sq. cm. ASTM D412) | 49 | 77 | 105 |
| Density (g/cu. cm.) | 1.09 | 1.08 | 1.10 |
| Elongation (% ASTM D412) | 300 | 350 | 250 |
| Tear resistance (kgf/sq. cm. ASTM D624) | 19.69 | 50.0 | 89.47 |
| Abrasion resistance (weight loss Mg/1000 rev. Tabor Abraser 18H Wheel) | 0.168 | 0.285 | 0.298 |

Of these three examples, the 94 Shore A compound is preferable because of its increased tear resistance and abrasion resistance. However, if the paddle is used at extremely low temperatures it may be preferable to use a less hard compound if the low temperature appears to decrease the effective resiliency of the material.

Before the urethane strip is adhered to the blade, it is preferably cleaned in a solvent such as methyl ethyl ketone and then the flat surface which will abut the tip of the blade is abraded on a sanding belt using aluminum oxide grit, after which it is again cleaned with the solvent. It is then adhered or bonded to the edge of the blade with an epoxy adhesive. This adhesive has, after curing a high bond strength of the order of 2800 pounds per square inch and high flexibility with an elongation of at least 10 per cent. The elongation may be varied by the temperature and duration of curing. A suitable epoxy from Armstrong Products Co., Warsaw, Ind., using C7 resin and W hardener or activator in a ratio of 2 parts resin to 3 parts hardener or activator provides an elongation of approximately 11.1 per cent a bond strength of 2730 psi, a tensile strength of 4190 psi and a tensile shear strength at room temperature of 2910 psi when cured at room temperature for one week whereas this same mixture can achieve 16.4 per cent elongation a bond strength of 2900 psi, a tensile strength of 4420 psi and a tensile shear strength of 4310 psi when cured at 165° F. for two hours, as is preferable.

The cross section outlines in FIGS. 3 through 13 are representative of the blade shape at points regularly spaced at two inch intervals starting at the tip and progressing away therefrom. In each of FIGS. 4 through 11 the edge of the blade is formed by a resilient shock-absorbing and abrasion-resistant strip 40 of the same material and adhered in the same manner as the previously described urethane rubber strip 30 at the tip of the blade. The blade edges and the urethane strips 30, 40 are bonded together on their entire facing surfaces. These strips 40 may be semi-circular in cross section as is indicated in FIGS. 4 through 13 with their flat face abutting the squared edge of the blade. It greatly facilitates the manufacture of these strips to have their cross-section uniform along their length.

The wood laminations in the paddle shaft and in the blade portion are bonded together by an epoxy adhesive which before curing has a low viscosity and the ability to saturate the wood pores at the surfaces to be bonded, including the scarf joint. This adhesive is also selected to be water-resistant or waterproof. A suitable epoxy adhesive is the WEST system epoxy sold by Gougeon Brothers of Bay City, Mich. for use in what they term a wood epoxy saturation technique. This epoxy also works well when reinforcing high tensile strength fibers of carbon, glass, polyester or aramid fiber are embedded in the bond at the interface between wood laminations as described elsewhere herein.

The laminations 5 and 9 are made of ash wood to provide maximum strength throughout the length of the shaft consistent with lightness of weight. The intermediate lamination 7 is made of sitka spruce. Since the laminations 5 and 9 terminate at points 5*a* and 9*a*, respectively, spaced from the tip of the blade because of the shaping of the concave and convex faces of the blade, the laminations 17 and 18 also of ash, are arranged generally perpendicular to the laminations 5 and 9 and extend to the tip of the paddle as seen in FIG. 1. These laminations 17 and 18, which throughout substantially their entire length have their major cross-sectional dimension perpendicular to the face or plane of the paddle blade, increase the strength of the blade throughout the longitudinally central portion of the blade and combine with the other ash laminations to give the paddle greater strength at the neck where the transition from a round shaft to a relatively flat blade takes place. The inwardly facing planar surfaces 17 and 18' of laminations 17 and 18 are next to and face the outer side surfaces of shift laminations 5, 7 and 9 to which they are bonded as described above. These planar surfaces 17' and 18', identified in FIGS. 12 and 15, are essentially parallel to each other and to the shaft and are perpendicular to the plane of the paddle as generally represented by the top edge of the blade in each of FIGS. 3 through 11.

The ash selected for the paddle may be white ash or other similar varieties which have the characteristics of being: straight-grained, strong, tough, and resilient wood which holds its shape well even under the action of water. It is more readily available than similar strong, tough and resilient woods such as yew and hickory. It is somewhat more dense than the other wood parts of the paddle, having a specific gravity of about 0.50 to 0.54. Hickory and yew are even heavier.

The laminations other than the ash laminations 5, 9, 17 and 18 are made of sitka spruce and basswood and are each substantially lighter than the ash and are used because of this weight advantage. Basswood is of the order of 64 per cent of the weight of ash. Basswood may have a specific gravity as low as 0.32 and sitka spruce of approximately 0.37. Both of these woods are straight-grained, take adhesives very well and are easy to shape with tools and finish smoothly. Birch or other similar fine-grained shock-resistant hardwood may be used in place of basswood for the outermost edge laminations 16 of the blade to provide a higher shock resistance than basswood. However, birch is also heavier, having about the same specific gravity as ash.

Both faces of the blade may be covered, except at the resilient strips 30 and 40 and the reinforcing strips 32, with a thin layer of glass fiber cloth adhered to the blade surfaces by a suitable waterproof adhesive to give further strength and abrasion resistance to the blade. An isothalic polyester resin has been found to be a suitable adhesive. A suitable cloth is 4 ounce S-glass cloth having an 18 by 18 plain weave mesh. The glass fiber layer is an aid in abrasion resistance for the entire blade surface and drapes well over the contours of the blade when wet with the resin so that a very smooth surface results with the grain of the wood highly visible through this protective layer.

FIGS. 16 and 17 show a modification of the invention wherein high tensile strength fibers are embedded in the bonds at the interfaces between the laminations 5 and 9 on the one hand and intermediate lamination portions 7*a* and 7*b* on the other. These interfaces are generally parallel to the plane of the blade and the fibers have their longitudinal axes parallel to the shaft. These fibers may be carbon, glass, polyester or aramid fibers. While some of these fibers may give extreme strength, a fiber which can be stretched slightly may give a better feel to the paddle by allowing it to bend slightly more. At the interface between the laminate portions 7*a* and 7*b* a woven fabric 50 of high tensile strength fibers is embedded. The fabric has fibers extending generally perpendicular to the wood laminations 5 and 9 to increase the strength of the intermediate shaft laminations.

Although certain specific examples have been given for the various woods, adhesives and strengthening and shock-absorbing material in order to practice the invention, these should not be construed as limiting the invention to only their use where there are obvious equivalents readily available which could be used within the spirit of this invention as defined in the following claims.

What I claim is:

1. A paddle blade of thin wood construction having a peripheral edge which is subject to abrasive wear and breakage if poked or rubbed against hard abrasive bodies during normal use or handling, said blade having bonded thereto along an an edge portion of the blade as an extension thereof a protective resilient rubber strip means of a thickness essentially the same thickness as the adjacent blade portion, said strip means having a portion of resilient rubber material extending in the direction away from the blade with a thickness:of said resilient rubber material in said direction of at least half the thickness of the adjacent balde portion, the entire surface of said rubber material facing toward the adjacent edge portion of the blade being bonded to said edge portion, said rubber material having greater abrasion resistance than the blade itself to provide a protective shock absorbing and abrasion resistant edge to the blade.

2. A blade according to claim 1, wherein the strip means is adhered to the blade and extends across the tip of the blade to protect it when it stands on end on an abrasive surface or when poked against rocks during use.

3. A blade according to claim 1, wherein the strip means is adhered to the blade and extends along opposite sides of the paddle to protect substantially the entire peripheral edge of the blade.

4. A blade according to claim 2, wherein the resilient abrasion resistant strip means is urethane rubber.

5. A blade according to claim 2, wherein the resilient abrasion resistant means has a durometer rating of 60 to 94 Shore A.

6. A blade according to claim 2, wherein the resilient abrasion resistant means has a durometer rating of 94 Shore A.

7. A blade according to claim 2, wherein the resilient abrasion resistant means has a durometer rating of 80 Shore A.

8. A blade according to claim 2, wherein the resilient abrasion resistant means has a durometer rating of 60 Shore A.

9. A paddle structure comprising a handle shaft and a blade, said handle shaft comprising outer laminations of strong tough and resilient wood and an intermediate lamination of a relatIvely light but strong wood, the interfaces of said handle shaft laminations being planar and extending essentially parallel to the plane of the blade, the outer laminations being bonded to said intermediate lamination at said interfaces, said outer shaft laminations extending to become parts of said blade but with the terminal ends thereof being substantially short of the tip of said blade, said intmediate lamination extending to the tip of the blade, said blade comprising additional strong, tough and resilient blade reinforcing laminations next to and on opposite sides of the shaft laminations, each reinforcing lamination having a planar surface facing the outer sides of said shaft laminations and being bonded thereto at said planar surface, said planar surfaces being generally parallel to each other and to said shaft and perpendicular to the plane of the blade, said reinforcing laminations extending throughout the length of the blade to provide increased strength therein at the neck of the paddle where the shaft and blade merge and throughout the length of the paddle beyond the terminal ends of said outer shaft laminations and the tip of the blade, said blade having convex and concave faces, the terminal end of one of said outer shaft laminations terminating at the concave blade face near the neck of the paddle, the other outer shaft lamination having its terminal end extending beyond the center of the convex blade face toward the tip of the blade, said blade having further laminations, of relatively lighter wood than the reinforcing laminations, and located on the outside of the reinforcing laminations on the sides thereof away from the shaft laminations.

10. A paddle according to claim 9, wherein said outer laminations and said reinforcing laminations are of ash wood and said intermediate handle lamination is of sitka spruce wood.

11. A paddle according to claim 9, wherein said outer laminations and said reinforcing laminations are of ash wood.

12. A paddle according to claim 9, wherein the edge of the paddle is at least partially protected by resilient abrasion resistant means comprising an elongated rubber strip means bonded to the edge of the blade and having at any point along its length a maximum thickness essentially equal to the thickness of the adjacent edge of the blade.

13. A paddle according to claim 12, wherein the strip means extends across the tip of the blade to protect it when it is stood on end on an abrasive surface or when poked against rocks or the shore during use.

14. A paddle according to claim 13, wherein the strip means extends along opposite sides of the paddle to protect substantially the entire peripheral edge of the blade.

15. A paddle according to claim 12, wherein the rubber strip means is urethane rubber.

16. A paddle according to claim 12, wherein the resilient abrasion resistant means has a durometer rating of 60 to 94 Shore A.

17. A paddle according to claim 12, wherein the resilient abrasion resistant means has a durometer rating of 94 Shore A.

18. A paddle according to claim 12, wherein the resilient abrasion resistant means has a durometer rating of 80 Shore A.

19. A paddle according to claim 12, wherein the resilient abrasion resistant means has a durometer rating of 60 Shore A.

20. A paddle construction according to claim 2, 4, 13 or 15, wherein a thin layer of high tensile strength fibers is bonded to each face of the paddle adjacent to the bond between the blade and the rubber strip means, said fibers extending in the direction parallel to the edge of the blade at the blade tip.

21. A paddle construction according to claim 20, wherein said fibers are carbon fibers.

22. A paddle structure comprising a handle shaft and a blade, said handle shaft comprising outer laminations of a strong tough and resilient wood and an intermediate lamination of a relatively light but strong wood, the interfaces of said handle shaft laminations being planar and extending essentially parallel to the plane of the blade, the outer laminations being bonded to said intermediate lamination at said interfaces, said outer shaft laminations extending to become parts of said blade but with the terminal ends thereof being substantially short of the tip of said blade, said intermediate lamination extending to the tip of the blade, said blade comprising additional strong, tough and resilient blade reinfocing laminations next to and on opposite sides of the shaft laminations, each reinforcing lamination having a planar surface facing the outer sides of said shaft laminations and being bonded thereto at said planar surface, said planar surfaces being generally parallel to each other and to said shaft and perpendicular to the plane of the blade, said reinforcing laminations extending the length of the blade to provide increased strength therein at the neck of the paddle where the shaft and blade merge and throughout the length of the paddle beyond the terminal ends of said outer shaft laminations and to the tip of the blade, said handle shaft having a thin layer of undirectional fibers of very high tensile strength embedded in the bond at each of the interfaces between the outer shaft laminations and the intermediate lamination and extending along substantially the entire length of the interface.

23. A paddle structure comprising a handle shaft and a blade, said handle shaft comprising outer laminations of a strong tough and resilient wood and an intermediate lamination of a relatively light but strong wood, the interfaces of said handle shaft laminations being planar and extending essentially parallel to the plane of the blade, the outer laminations being bonded to said intermediate lamination at said interfaces, said outer shaft laminations extending to become parts of said blade but with the terminal ends thereof being substantially short of the tip of said blade, said intermediate lamination extending to the tip of the blade, said blade comprising additional strong, tough and resilient blade reinforcing laminations next to an on opposite sides of the shaft laminations, each reinforcing lamination having a planar surface facing the outer sides of said shaft laminations and being bonded thereto at said planar surface, said planar surfaces being generally parallel to each other and to said shaft and perpendicular to the plane of the blade, said reinforcing laminations extending throughout the length of the blade to provide increased strength therein at the neck of the paddle where the shaft and blade merge and throughout the length of the paddle beyond the terminal ends of said outer shaft laminations and to the tip of the blade, said intermediate shaft lamination comprising two parts having opposed surfaces at a central planar interface extending longitudinally of the shaft and perpendicular to the plane of the blade, high tensile strength fibers between said opposed surfaces and extending along said central interface, said opposed surfaces and said fibers being adhered to each other by a water resistant epoxy bond.

24. A paddle construction according to claim 20, wherein the blade comprises thin wood protions having the wood grain thereof extending generally parallel to the length of the paddle.

25. A paddle construction according to claim 21, wherein the blade comprises thin wood portions having the wood grain thereof extending generally parallel to the length of the paddle.

26. A paddle blade of thin construction having a peripheral edge which, if unprotected, would be subject to abrasive wear and damage if poked or rubbed against hard abrasive bodies during normal use or handling, an elongated protective strip means bonded thereto along an an edge portion of the blade as an extension thereof, said resilient strip means having a thickness essentially the same as the adjacent portion of the blade, said strip means having a portion of resilient elastomeric material extending in the direction away from the blade with a thickness of said resilient elastomeric material in said direction of at least half the thickness of the adjacent blade portion, the entire surface of said elastomeric material facing toward the adjacent edge portion of the blade being bonded to said edge portion, said elastomeric material having greater abrasion resistance than the blade itself to provide a protective shock absorbing and abrasion resistant edge to the blade.

27. A paddle according to claim 26, wherein the protective strip means is recessed to receive the edge of the blade.

28. A paddle according to claim claim 20 or 27, wherein a length of material of high tensile strength in the direction parallel to said strip means is bonded to the paddle adjacent to the resilient protective strip means, said high tensile strength material extending along the edge of the blade at the blade tip.

29. A paddle construction according to claim 28, wherein the blade comprises thin wood portions having the wood grain thereof extending generally parallel to the length of the paddle.

30. A paddle structure comprising a handle shaft and a blade, said handle shaft comprising outer laminations of a strong, tough, and resilient wood and an intermediate lamination of a relatively light but strong wood, the interfaces of said handle shaft laminations being planar and extending essentially parallel to the plane of the blade, the outer laminations being bonded to said intermediate lamination at said interfaces, said handle shaft having a thin layer of longitudinally extending undirectional fibers of very high tensile strength embedded in the bond and disposed inwardly of the shaft exterior at each of the interfaces between the outer shaft laminations and the intermediate lamintion and extending along substantially the entire length of each respective interface.

31. A paddle structure comprising a handle shaft and a blade, said handle shaft comprising outer laminations of a strong, tough, and resilient wood and an intermediate lamination of a relatively light but strong wood, the interfaces of said handle shaft laminations being planar and extending essentially parallel to the plane of the blade, the outer laminations being bonded to said intermediate lamination at said interfaces, said intermediate shaft lamination comprising two parts having opposed surfaces bonded together at a central planar interface extending longitudinally of the shaft and perpendicular to the plane of the blade, and, high tensile strength fibers imbedded in the bond between said opposed surfaces and disposed inwardly of the shaft exterior, said fibers extending along said central interface of said shaft lamination.

* * * * *